US008701781B2

(12) United States Patent
Henschel et al.

(10) Patent No.: US 8,701,781 B2
(45) Date of Patent: Apr. 22, 2014

(54) SUBSURFACE SAFETY VALVE FLAPPER

(75) Inventors: Robert C. Henschel, The Woodlands, TX (US); Robert Jancha, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 54 days.

(21) Appl. No.: 13/289,185

(22) Filed: Nov. 4, 2011

(65) Prior Publication Data

US 2012/0111575 A1 May 10, 2012

Related U.S. Application Data

(63) Continuation of application No. 13/009,171, filed on Jan. 19, 2011, now abandoned, which is a continuation of application No. 12/351,609, filed on Jan. 9, 2009, now abandoned.

(51) Int. Cl.
*E21B 34/08* (2006.01)

(52) U.S. Cl.
USPC ..... 166/373; 166/332.8; 166/332.7

(58) Field of Classification Search
USPC ..... 166/332.8, 373, 324, 323, 332.7
See application file for complete search history.

(56) References Cited

U.S. PATENT DOCUMENTS 4,478,286 A * 10/1984 Fineberg ..... 166/324
6,079,497 A * 6/2000 Johnston et al. ..... 166/324

* cited by examiner

*Primary Examiner* — Kenneth L Thompson
(74) *Attorney, Agent, or Firm* — McGlinchey Stafford; R. Andrew Patty, II

(57) ABSTRACT

A flapper for use as a component of a safety valve designed for deployment in a well bore having well bore fluids. The flapper includes a flapper body forming a flapper valve bore therethrough. The flapper body forms a groove proximate to the flapper bore. The flapper also includes a plunger member sized and configured to be received in the flapper valve bore. The plunger member includes a first end portion and a second end portion. Additionally, the flapper includes a leaf spring including a primary end portion and a secondary end portion, the primary end portion of the leaf spring detachably attached to the second end portion of the plunger member and unattached to the flapper body and the secondary end portion of the leaf spring being sized and configured to be received and retained in the groove and to bias the plunger member into the flapper valve bore.

15 Claims, 3 Drawing Sheets

SUBSURFACE SAFETY VALVE FLAPPER

REFERENCE TO RELATED APPLICATIONS

This application is a Continuation of U.S. application Ser. No. 13/009,171, filed Jan. 19, 2011 which in turn is a Continuation of U.S. application Ser. No. 12/351,609, filed Jan. 9, 2009, which is incorporated herein by reference.

TECHNICAL FIELD

This invention relates to subsurface safety valves for deployment in hydrocarbon producing wells, particularly subsurface safety valves comprising flappers.

BACKGROUND

Typically, a hydrocarbon producing well will include a subsurface safety valve to seal off a section of production tubing in the event of an emergency, e.g., damage to the well head. This type of valve is usually activated from the surface using a hydraulic control system with control lines that run from the surface to the subsurface safety valve. The valve typically comprises a valve housing and a closure member used to seal the production tubing in the well bore. The closure member typically used is a flapper which is hingedly attached to the valve housing and rotatable throughout an arc of ninety degrees between an open and closed position. The control system uses hydraulic pressure to move a hollow tube, usually referred to as a flowtube, downwardly against the flapper and a return spring, thereby disposing the flapper in an open position such that hydrocarbons may flow in the production tubing. Once, the hydraulic pressure is lost in the system, the flow tube moves upwardly thereby allowing the return spring to bias the flapper in a closed position effectively sealing off from the surface the flow of hydrocarbons in the production tubing.

Once the flapper is in the closed position, formation pressure accumulates on the upstream side of the flapper. This increase in pressure causes a high pressure differential across the flapper making the opening of the flapper difficult. One manner to solve this problem is to incorporate an equalizing or bleed valve assembly in the flapper. Such an equalizing valve assembly typically comprises a plunger or like member, a spring, and hardware to fasten the spring and plunger to the flapper. The plunger, typically biased against the flapper by the spring, is displaced to allow the pressure differential to dissipate across the flapper thereby reducing the difficulty in disposing the flapper in an open position.

SUMMARY OF THE INVENTION

It now has become apparent that a need exists for a durable equalizing valve assembly which can withstand the extreme forces generated by the and on the flapper when it slams closed during use. The flapper is commonly exposed to extreme forces during closing. Those forces may damage the equalizing valve assembly components, especially the hardware used to fasten the equalizing valve assembly to the flapper.

The present invention is deemed to meet the foregoing need, amongst others, by providing in at least one embodiment, a flapper comprising a durable and efficient flapper valve assembly capable of dissipating a pressure differential across the flapper. In at least one embodiment of the present invention, the flapper valve assembly is designed to withstand high external forces created by the slamming of the flapper when closing by requiring no additional hardware to fasten the components of the flapper valve assembly to the flapper.

One embodiment of the present invention provides a flapper for use as a component of a safety valve designed for deployment in a well bore having well bore fluids. The flapper comprises a flapper body forming a flapper valve bore therethrough. The flapper body further forms a groove proximate to the flapper bore. The flapper also comprises a plunger member sized and configured to be received in the flapper valve bore, the plunger member comprising a first end portion and a second end portion. Additionally, the flapper comprises a leaf spring comprising a primary end portion and a secondary end portion, the primary end portion of the leaf spring detachably attached to the second end portion of the plunger member and unattached to the flapper body and the secondary end portion of the leaf spring being sized and configured to be received and retained in the groove and to bias the plunger member into the flapper valve bore. Forces exerted on the flapper body when rotating between an open state and a closed state during use of the safety valve urge at least a portion of the leaf spring into the groove. In this way, the components of the flapper maintain their structural relationship with one another despite being exposed to the forces associated with the repeated opening and closing of the safety valve during operation.

Another embodiment of this invention is a method for equalizing differential pressure across a safety valve deployed in a well bore having well bore fluids. The method comprises deploying the safety valve in the well bore. The safety valve comprises a flapper, wherein the flapper comprises a flapper body forming a flapper valve bore therethrough. The flapper body further forms a groove proximate to the flapper bore. The method further comprises biasing a plunger member in the flapper valve bore by coupling the plunger member to a leaf spring comprising a primary end portion and a secondary end portion. The plunger member is sized and configured to be received in the flapper valve bore and further comprises a first end portion and a second end portion. The primary end portion of the leaf spring is coupled to the second end portion of the plunger member. The secondary end portion of the leaf spring is sized and configured to be received and retained in the groove. The method further comprises displacing the plunger member to allow fluid to flow from a portion of the well bore having higher pressure to a portion of the well bore having lower pressure. Displacing the plunger member causes the primary end portion of the leaf spring to rotate about the latitudinal axis of the flapper, whereby the pressure differential across the safety valve is equalized.

Still yet, another embodiment of the present invention provides a method for retaining a flapper valve in a flapper in a safety valve designed for deployment in a well bore. The method comprises providing a flapper valve bore in the flapper. The flapper valve bore extends through the flapper and the flapper further defines a groove extending distally from the flapper valve bore. The method further comprises biasing a plunger member into the flapper valve bore by coupling the plunger member to a leaf spring. The leaf spring is disposed in the groove and extends distally from the plunger member. The leaf spring is urged into the groove when forces are exerted on the flapper and thereby retains the plunger member in the flapper valve bore.

These and other features of this invention will be still further apparent from the ensuing description, drawings, and appended claims.

FURTHER DETAILED DESCRIPTION OF THE INVENTION

Illustrative embodiments of the invention are described below as they might be employed in the construction and use of a subsurface safety valve flapper and methods according to the present invention. In the interest of clarity, not all features of an actual implementation are described in this specification. It will be of course appreciated that in the development of such an actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
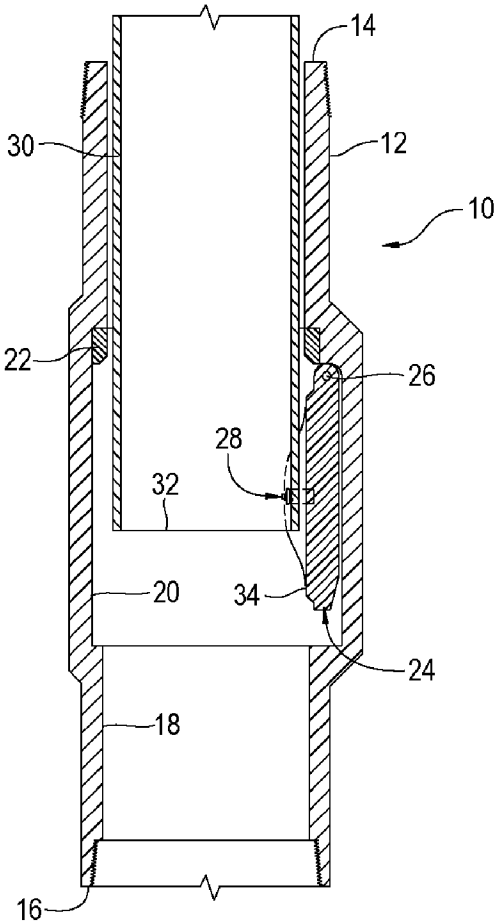
FIG. 2 is a cross sectional view of a subsurface safety valve, wherein the flapper is in a open state consistent with one embodiment of the present invention.
Figure 1:
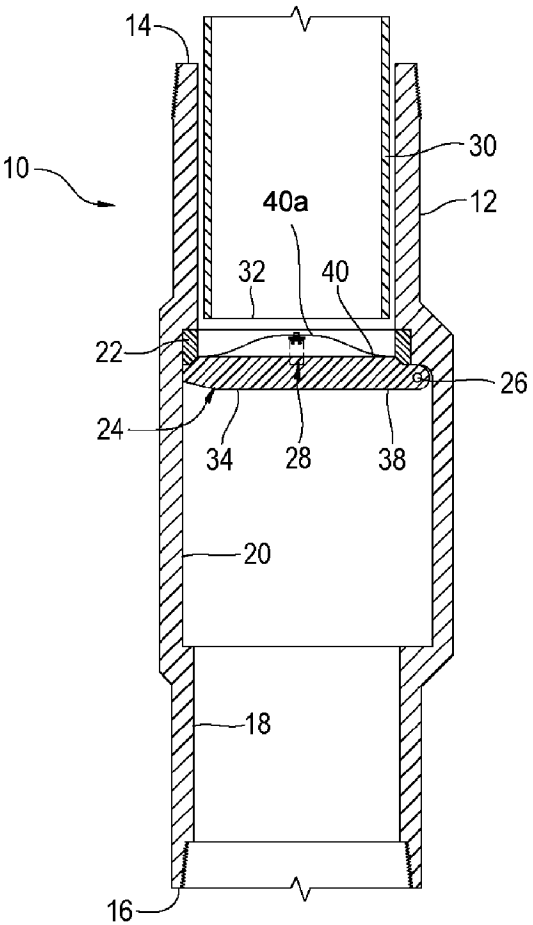
FIG. 1 is a cross sectional view of a subsurface safety valve, wherein the flapper is in a closed state consistent with one embodiment of the present invention.

Turning now to the figures, FIGS. 1 and 2 illustrate a subsurface safety valve 10 consistent with at least one embodiment of the present invention. When deployed in a well bore (not shown), subsurface safety valve 10 is commonly incorporated into the production tubing (not shown). Subsurface safety valve 10 includes a valve housing 12 comprising a first end portion 14 and a second end portion 16. First end portion 14 of the housing 12 is threaded for attachment to an adjacent string of production tubing (not shown) and second end portion 16 of the housing 12 is threaded for attachment with an adjacent section of production tubing (not shown). The valve housing 12 further defines a bore 18 for fluid flow there through. The valve housing 12 further includes an enlarged central portion 20, wherein an annular valve seat 22 is secured within the central portion 20. As illustrated in FIG. 1, the subsurface safety valve 10 would function to inhibit fluid flow from the direction of the second end portion 16 to the first end portion 14 of the valve housing 12. Thus, the second end portion 16 will be considered upstream to the first end portion 14.

As illustrated in FIGS. 1 and 2, subsurface safety valve 10 further comprises a flapper 24, wherein the flapper 24 is hingedly secured to the valve seat 22 by hinge pin 26. The flapper 24 may rotate about the hinge pin 26 in approximately a 90° range of motion, between an open state (shown in FIG. 2) and a closed state, as shown in FIG. 1. In the closed state, flapper 24 is in contact and seated on the valve seat 22, thereby forming a sealing relationship with the valve seat 22. A torsion spring (not shown) biases the flapper 24 in a closed state, as shown in FIG. 2. With the flapper 24 and valve seat 22 forming the sealing relationship as shown in FIG. 1, the subsurface safety valve 10 inhibits fluid flow from the upstream portion of the well bore to the downstream portion of the well bore. As illustrated, the flapper 24 further comprises a pressure equalizing assembly 28, the structure and function of which will be discussed further below.

An actuation member 30, which may be a conventional actuation tube or sleeve, is disposed within the housing bore 18 downstream of the valve seat 22 and may be shifted along the longitudinal axis of the housing bore 18, typically by means of hydraulic pressure or shifting tools; however, actuation member 30 may be shifted by other means known in the art. Actuation member 30 is shifted between an upper position (as shown in FIG. 1) and a lower position (as shown in FIG. 2). Actuation member 30 comprises a lower end portion 32, the lower end portion 32 may be substantially flat. Actuation member 30 is shifted to allow the flapper 24 to rotate between open and closed states depending on the position of the actuation member 30.

Figure 3:
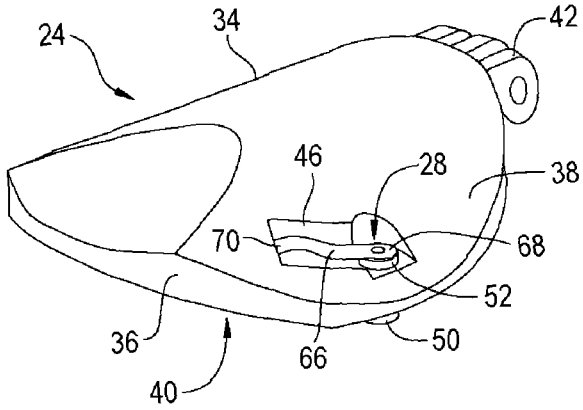
FIG. 3 is a perspective view of a flapper consistent with one embodiment of the present invention.
Figure 4:
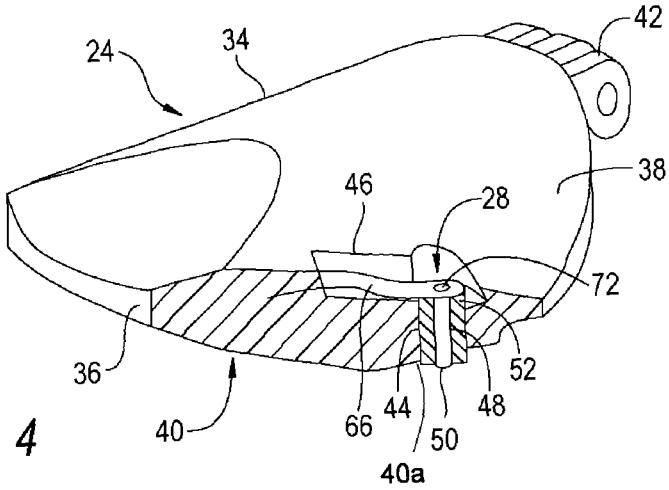
FIG. 4 is a cross sectional view of a flapper body and a flapper valve consistent with one embodiment of the present invention.
Figure 5:
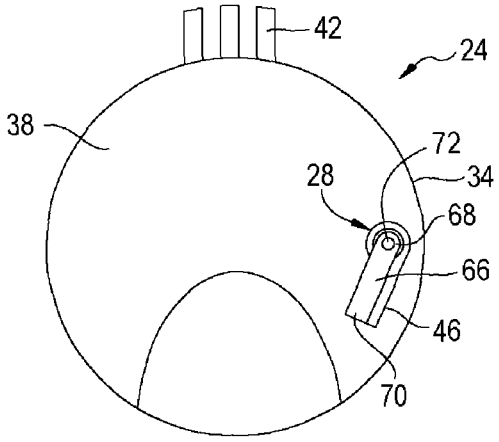
FIG. 5 is a top plan view of a flapper consistent with one embodiment of the present invention.

Turning now to FIGS. 3 through 5, the flapper 24 and pressure equalizing assembly 28 may be better understood. Flapper 24 comprises a flapper body 34, wherein the flapper body 34 is curved. The flapper body 34 is a generally saddle-shaped disc, wherein the flapper body 34 is arcuately curved to provide a curvature that approximately matches the interior surface of the housing 12. As shown in FIGS. 3 and 4, the flapper body 34 arcuately curves away from a latitudinal axis of the flapper body 34 when viewed from the upstream face 38 of the flapper 24. The flapper body 34 is curved in order to allow for a smaller outer diameter of the valve housing 12 while increasing the surface sealing contact between the flapper body 34 and the valve seat 22. The flapper body 24 further forms a rounded radial perimeter 36 that is sized and configured to retain a sealing relationship with the valve seat 22 when the flapper 24 is in contact with the valve seat 22. The flapper body 34 comprises an upstream face 38 and a downstream face 40, the upstream face 38 receiving the fluid pressure from the upstream portion of the well bore when the flapper 24 is in a closed state. The downstream face 40 comprises contact portions **40*a*, the contact portions sized and configured to be contacted by the actuation member 30 to facilitate the rotation of the flapper 24 between states. The contact portions may be substantially flat so that the contact portions may contact the lower end portion 32 of the actuation member 30 in a mating fashion. The flapper body 34 further forms at least one hinge component 42, illustrated as a hinge, sized and configured for hinged attachment to the safety valve 10, wherein the hinged component 42** extends radially from the flapper body.

As illustrated in FIGS. 3 through 5, flapper body 34 further forms a flapper valve bore 44 therethrough, the location of the flapper valve bore 44 being within the contact portion **40*a* of the downstream face 40 of the flapper 24. Flapper body 34 further forms a groove 46 proximate to the flapper bore 44 in the upstream face 38 of the flapper 24. Groove 46 extends distally from the flapper valve bore 44 toward the portion of the flapper body 34 directly opposing the hinged component 42**.

Figure 6:
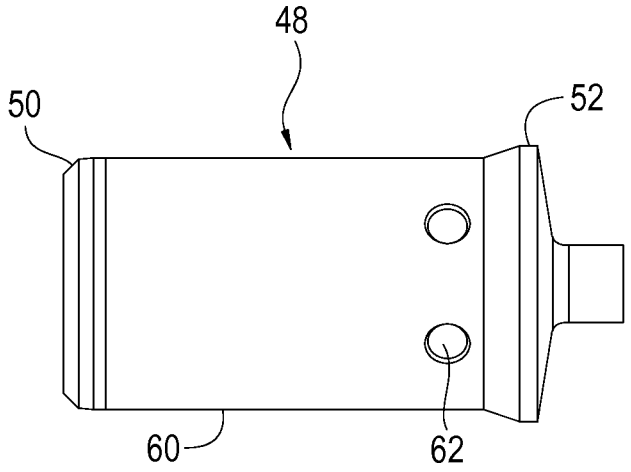
FIG. 6 is a perspective view of a plunger member comprising a plurality of fluid pathways consistent with one embodiment of the present invention.
Figure 7:
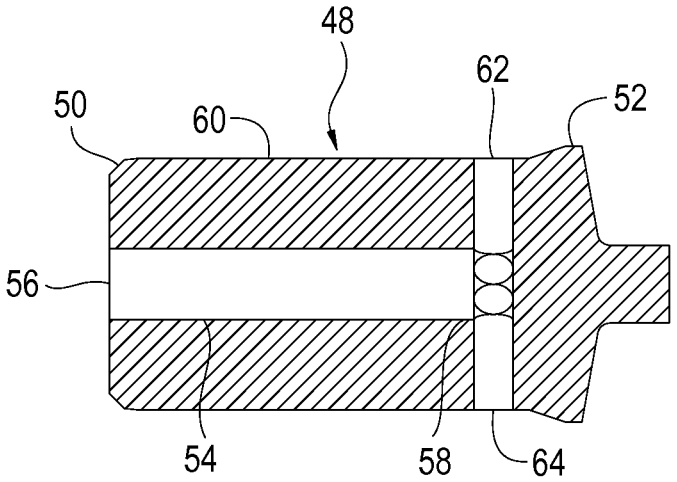
FIG. 7 is a cross-sectional view of a plunger member comprising a plunger member bore and a plurality of fluid pathways consistent with one embodiment of the present invention.
Figure 8:
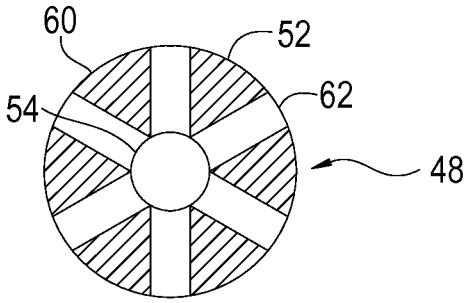
FIG. 8 is a top plan view of a plunger member comprising a plunger member bore and a plurality of fluid pathways consistent with one embodiment of the present invention In each of the above figures, like numerals are used to refer to like or functionally like parts among the several figures.

Flapper 24 further comprises a plunger member 48, illustrated in FIGS. 6 through 8 as a plunger, is sized and configured to be received in the flapper valve bore 44. Plunger 48 is further sized and configured to shift within the flapper valve bore 44; however, plunger 48 forms a sealing relationship with the flapper valve bore 44 when disposed within the valve bore 44. Plunger 48 comprises a first end portion 50 and a second end portion 52, wherein the first end portion 50 of the plunger 48 protrudes above the downstream face 40 of the flapper 24. The first end portion 50 of the plunger 48 may be substantially flat so that the substantially flat lower end portion 32 of the actuation member 30 may be in a mating fashion with the first end portion 50 of the plunger 48 when actuation member 30 is shifted and placed in contact with the first end portion 50 of the plunger 48.

Plunger 48 further forms a plunger member bore 54 therethrough, as illustrated as a plunger bore in FIGS. 7 and 8. Plunger bore 54 comprises a first end 56 and a second end 58, wherein the first end 56 is located at the first end portion 50 of the plunger 48 and is in fluid communication with the upstream portion of the well bore. Plunger 48, as illustrated, is cylindrical in form and further comprises a continuous sidewall 60. Plunger 48 further forms at least one fluid pathway 62 in fluid communication with the plunger member bore 54. Fluid pathway 62 extends from the plunger bore 54 to the sidewall 60 of the plunger 48. Plunger bore 54 and fluid pathway 62 provide a fluid passageway 64 through the flapper valve bore 54 when the plunger 48 is disposed in the flapper valve bore 44 but is sufficiently displaced from the flapper valve bore 44 so that the fluid passageway 64 is in fluid communication with both an upstream side of the flapper 24 and a downstream side of the flapper 24.

As shown in FIGS. 3 through 5, flapper 24 further comprises a leaf spring 66. As illustrated, leaf spring 66 extends distally from the flapper valve bore 44. Leaf spring 66 comprises a primary end portion 68 and a secondary end portion 70. The primary end portion 68 of the leaf spring 66 is detachably attached to the second end portion 52 of the plunger 48 and unattached to the flapper body 34 and the secondary end portion 70 of the leaf spring 66 is sized and configured to be received and retained in the groove 46 and to bias the plunger 48 into the flapper valve bore 44. The primary end portion 68 of the leaf spring 66 may further define a leaf spring aperture 72, wherein the second end portion 52 of the plunger 48 may be inserted through the leaf spring aperture 72 and mechanically coupled to the leaf spring 66. The leaf spring 66 is received and retained in the groove 46 such that forces exerted on the flapper body 34 when rotating between an open state and a closed state during use of the safety valve 10 urge at least a portion of the leaf spring 66 into the groove 46.

Plunger 48 is movably disposed within the flapper valve bore 44 between an open position and a closed position. In the open position, fluid may flow through the fluid passageway 64 from the upstream portion of the well bore to the downstream portion of the well bore. In its normal state, plunger 48 is biased in the closed position by the leaf spring 66 such that the plunger 48 creates a sealing relationship with the flapper valve bore 44 so that fluid is unable to flow through the fluid passageway 64. In the closed position, first end portion 50 of the plunger 48 extends above the contact portion 40*a* of the flapper body 34.

In operation, the subsurface safety valve 10 is opened by moving the flapper 24 from the closed position illustrated in FIG. 1 to the open position illustrated in FIG. 2. This is accomplished by displacing the actuation member 30 from its upper position shown in FIG. 1 downward toward the upstream portion of the well bore until the lower end portion 32 of the actuation member 30 contacts the first end portion 50 of the plunger 48. This contact urges the plunger 48 into an open position, thereby compressing the leaf spring 66. Fluid from the upstream portion of the well bore may now flow to the downstream portion of the well bore. Thus, pressure across the flapper 24 is reduced or equalized. As the actuation member 30 further moves in the upstream direction towards its lower position, the actuation member 30 contacts the contact portions of the flapper body 34, thereby bringing the actuation member 30 and contact portions into mating contact and allows the flapper 24 to be urged into an open position as the actuation member 30 travels to its lower position.

In order to close the subsurface safety valve 10, the actuation member 30 is moved upwardly in the downstream direction towards the upper position of the actuation member 30. As the actuation member 30 moves upward, the torsion spring (not shown) urges the flapper 24 towards its closed state. When the production tubing (not shown) incorporating the subsurface safety valve 10 contains fluid flowing at a high flow rate or under significant pressure, the flapper 24 may slam shut against the valve seat 22 with tremendous force. This force actually aids in retaining the components of the pressure equalizing assembly 28, namely the leaf spring 66 and plunger 48, disposed in the flapper body 34 by urging the leaf spring 66 into the groove 46 when such forces slam the flapper 24 against the valve seat 22. By providing a groove 46 in the flapper body 34 and minimizing the amount of hardware in the pressure equalizing assembly 28, it extremely unlikely that any component of the pressure equalizing assembly 28 would become dislodged from the subsurface safety valve 10.

One of ordinary skill in the art will understand that the components of the subsurface safety valve, including the flapper body and pressure equalizing assembly, may be made from high strength steel materials, composites or non-elastomeric materials.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

This invention is susceptible to considerable variation within the spirit and scope of the appended claims.

The invention claimed is:

1. A flapper for use as a component of a safety valve designed for deployment in a well bore having well bore fluids, the flapper comprising a flapper body forming a flapper valve bore therethrough within a contact portion of a downstream face of the flapper body, the flapper body further forming a groove proximate to the flapper valve bore;

a plunger member sized and configured to be received in the flapper valve bore, the plunger member comprising a first end portion and a second end portion, the first end portion of the plunger member configured to be contacted by an actuation member which is not attached to the flapper; and a leaf spring comprising a primary end portion and a secondary end portion, the primary end portion of the leaf spring detachably attached to the second end portion of the plunger member and unattached to the flapper body and the secondary end portion of the leaf spring being sized and configured to be received and retained in the groove and to bias the plunger member into the flapper valve bore, wherein forces exerted on the flapper body when rotating between an open state and a closed state during use of the safety valve urge at least a portion of the leaf spring into the groove.

2. A flapper according to claim 1 wherein the primary end portion of the leaf spring is mechanically coupled to the second end portion of the plunger member.

3. A flapper according to claim 1 wherein the primary end portion of the leaf spring further defines a leaf spring aperture, wherein the second end portion of the plunger member is inserted through the leaf spring aperture and mechanically coupled to the leaf spring.

4. A safety valve for deployment in a well bore having well bore fluids wherein the safety valve comprises a flapper in accordance with claim 1.

5. A flapper according to claim 1 wherein the flapper body is curved.

6. A flapper according to claim 1 wherein the flapper body further forms at least one hinge component sized and configured for hinged attachment to the safety valve.

7. A flapper according to claim 1 wherein at least a portion of the groove extends distally from the flapper valve bore.

8. A flapper according to claim 1 wherein at least a portion of the leaf spring extends distally from the flapper valve bore.

9. A flapper according to claim 1 wherein the plunger member further forms a plunger member bore therethrough.

10. A flapper according to claim 9 wherein the plunger member further forms at least one fluid pathway in fluid communication with the plunger member bore, the plunger member bore and fluid pathway providing at least one fluid passageway through the flapper valve bore when the plunger member is disposed in the flapper valve bore but is sufficiently displaced from the flapper valve bore so that the fluid passageway is in fluid communication with both an upstream side of the flapper body and a downstream side of the flapper body.

11. A method for equalizing differential pressure across a safety valve deployed in a well bore having well bore fluids, the method comprising deploying the safety valve in the well bore, the safety valve comprising a flapper, wherein the flapper comprises a flapper body forming a flapper valve bore therethrough within a contact portion of a downstream face of the flapper body, the flapper body further forming a groove proximate to the flapper valve bore;

biasing a plunger member comprising a first end portion and a second end portion in the flapper valve bore, the first end portion of the plunger member configured to be contacted by an actuation member which is not attached to the flapper, by coupling the second end portion of the plunger member to a leaf spring comprising a primary end portion and a secondary end portion, the plunger member being sized and configured to be received in the flapper valve bore and further comprising a first end portion and a second end portion and the primary end portion of the leaf spring being coupled to the second end portion of the plunger member and the secondary end portion of the leaf spring being sized and configured to be received and retained in the groove; and displacing the plunger member by contacting the first end portion of the plunger member and an actuation member which is not attached to the flapper, to allow fluid to flow from a portion of the well bore having higher pressure to a portion of the well bore having lower pressure, wherein displacing the plunger member causes the primary end portion of the leaf spring to rotate about the latitudinal axis of the flapper, whereby the pressure differential across the safety valve is equalized.

12. A method according to claim 11 wherein the plunger member forms a plunger member bore therethrough, the plunger member bore further forming at least one fluid pathway in fluid communication with the plunger member bore, the plunger member bore and fluid pathway providing at least one fluid passageway through the flapper valve bore when at least a portion of the plunger member is displaced from the flapper valve bore and the fluid passageway further allowing fluid to flow from the portion of the well bore having higher pressure to the portion of the well bore having lower pressure thereby equalizing the pressure across the flapper.

13. A method according to claim 11 further comprising the step of opening the flapper after the pressure differential has been equalized.

14. A method for retaining a flapper valve in a flapper in a safety valve designed for deployment in a well bore, the method comprising providing a flapper valve bore in the flapper within a contact portion of a downstream face of the flapper, the flapper valve bore extending through the flapper and the flapper further defining a groove extending distally from the flapper valve bore, and biasing a plunger member comprising a first end portion and a second end portion into the flapper valve bore, the first end portion of the plunger member configured to be contacted by an actuation member which is not attached to the flapper, by coupling the second end portion of the plunger member to a leaf spring, the leaf spring disposed in the groove and extending distally from the plunger member, whereby the leaf spring is urged into the groove when forces are exerted on the flapper thereby retaining the plunger member in the flapper valve bore.

15. A method according to claim 14 further comprising the step of deploying the safety valve in the well bore.

* * * * *